US005100751A

United States Patent [19]

Kato et al.

[11] Patent Number: 5,100,751

[45] Date of Patent: Mar. 31, 1992

[54] LIQUID DEVELOPING AGENT FOR ELECTROSTATIC PHOTOGRAPHY

[75] Inventors: Eiichi Kato; Kazuo Ishii; Hiroshi Ishibashi, all of Shizuoka, Japan

[73] Assignee: Fuji Photo Film Co., Ltd., Kanagawa, Japan

[21] Appl. No.: 406,015

[22] Filed: Sep. 12, 1989

[30] Foreign Application Priority Data

Sep. 12, 1988 [JP] Japan ..... 63-226550

[51] Int. Cl.[5] ..... G03G 9/12

[52] U.S. Cl. ..... 430/114; 430/115; 430/904

[58] Field of Search ..... 430/114, 115, 904

[56] References Cited

U.S. PATENT DOCUMENTS

| | | | |
|---|---|---|---|
| 4,663,265 | 5/1987 | Uytterhoeven | 430/115 |
| 4,840,865 | 6/1989 | Kato et al. | 430/114 |
| 4,873,166 | 10/1989 | Senga et al. | 430/137 |
| 4,877,698 | 10/1989 | Watson et al. | 430/115 |
| 5,041,352 | 8/1991 | Kato et al. | 430/114 |
| 5,043,241 | 8/1991 | Kato et al. | 430/114 |

*Primary Examiner*—Marion E. McCamish
*Assistant Examiner*—S. Crossan
*Attorney, Agent, or Firm*—Sughrue, Mion, Zinn, Macpeak & Seas

[57] ABSTRACT

Liquid developing agent for electrostatic photography comprising resin grains dispersed in a non-aqueous solvent with an electrical resistance of $10^9$ 106 cm or more and a permittivity of 3.5 or less, wherein said dispersed resin grains are polymer resin grains produced by a polymerization reaction of a solution containing at least one monofunctional monomer (A) which is soluble in the nonaqueous solvents, but is made insoluble by polymerization, and at least one resin (B) for dispersion stabilization that is soluble in said nonaqueous solvent and is a polymer which has repeating units represented by formula (I) below, a portion of which is crosslinked and in which an acidic group selected from among $-PO_3H_2$, $-SO_3H$, $-COOH$, $-OH$, $-SH$ and

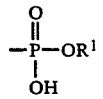

groups, where $R^1$ represents a hydrocarbon group, is bonded to only one end of at least one polymer main chain.

9 Claims, No Drawings

LIQUID DEVELOPING AGENT FOR ELECTROSTATIC PHOTOGRAPHY

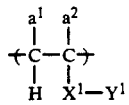

(I)

wherein $X^1$ represents —COO—, —OCO—, —$CH_2$OCO—, —$CH_2$COO—, —O— or —$SO_2$—;

$Y^1$ represents an aliphatic group having from 6 to 32 carbon atoms; and $a^1$ and $a^2$ may be the same or different and each represents a hydrogen atom, a halogen atom, a cyano group, a hydrocarbon group having from 1 to 8 carbon atoms, —COO—$Z^1$ or —COO—$Z^1$ linked via a hydrocarbon group having from 1 to 8 carbon atoms, where $Z^1$ represents a hydrocarbon group having from 1 to 18 carbon atoms.

FIELD OF THE INVENTION

The present invention relates to a liquid developing agent for electrostatic photography in which at least a resin is dispersed in a carrier solution with an electrical resistance of $10^9$ Ω cm or more and a permittivity of 3.5 or less. More particularly, the invention relates to a liquid developing agent which has excellent re-dispersibility, storability and stability and which imparts excellent image reproducibility and fixing characteristics.

BACKGROUND OF THE INVENTION

Ordinary liquid developing agents for electrostatic photography are agents in which an organic or inorganic pigment or dye such as carbon black, nigrosine or phthalocyanine blue, etc. and a natural or synthetic resin such as an alkyd resin, acrylic resin, rosin or synthetic rubber, etc. are dispersed in an aliphatic petroleum hydrocarbon or similar highly insulating, low permittivity liquid and which are further given addition of a polarity control agent such as a metal soap, lecithin, linseed oil, a higher fatty acid or vinyl pyrrolidone, etc.

The resin in such developing agents is dispersed in the form of insoluble latex grains with a diameter of several nanometers to several hundred nanometers, and in a conventional liquid developing agent a soluble resin for dispersion stabilization and a polarity control agent are in a state in which they are easily dispersed in the solution since there is imperfect bonding between them and the insoluble latex grains. Consequently, there is the drawback that on long-term storage or repeated use the soluble dispersion stabilization resin becomes detached from the insoluble latex grains, the grains precipitate, aggregate and accumulate and the polarity becomes unclear. Further, since it is difficult to re-disperse the grains once they have aggregated and accumulated, the grains remain adhering everywhere to the development unit, so leading to staining of image portions and development unit problems such as solution feed pump blockage, etc.

A means which has been proposed for making improvement with respect to this drawback and has been disclosed in U.S. Pat. No. 3,990,980 is to bring about chemical bonding of the soluble dispersion stabilization resin and insoluble latex grains. However, although the dispersibility stability with respect to the natural precipitation of grains is improved to some extent in such a liquid developing agent, it is still unsatisfactory and when the developing agent is put into and used in an actual development apparatus there are the drawbacks that toner adhering to various portions of the apparatus hardens as a film, re-dispersion is difficult and apparatus malfunction and staining of images, etc. are caused and there is insufficient re-dispersibility for practical purposes. In the above-noted procedure for manufacture of the grains, if monodisperse grains with a narrow grain size distribution are expected to be produced, there are great restrictions with regard to the combinations of dispersion stabilization agent used and the monomer to produce insolubilized polymer. Further, in the above-noted procedure for manufacture of the grains, grains with a broad grain size distribution comprising a large amount of coarse grains or polydisperse grains in which two or more average grain diameters are present are produced. Also, since it is difficult to achieve a required average grain size in monodisperse grains with a narrow grain size distribution, large grains of 1 μm or more or very fine grains of 0.1 μm or less are formed. There have also been the problems such as the fact that the dispersion stabilization agents used have to be manufactured by going through complex and time-consuming manufacturing stages.

JP-A-60-185962 and JP-A-61-43757 (the term "JP-A" as used herein means an "unexamined published Japanese patent application") disclose methods wherein, in order to provide improvement with respect to these drawbacks, the degree of dispersion, re-dispersibility and storage stability of grains are improved by producing insoluble dispersion resin grains by polymerizing the monomer in the presence of a polymer for which a bifunctional monomer has been used or a polymer for which a macromolecular reaction has been used.

Another aspect is that in recent years, methods of printing a large number of sheets, 5000 or more, using a master plate for offset printing by an electronic photographic system have been tried and particular advances have been made in improvements of master plates with the result that it has become possible to print 10,000 or more large-size sheets. Progress has also been made in connection with shortening of work times in electronic photographic plate making systems and improvements have been made with respect to speeding-up of development stage to fixing stage.

With dispersed resin grains manufactured by the means disclosed in the above-noted JP-A-60-185962 and JP-A-61-43757, there is still failure to always achieve satisfactory performance with respect to dispersibility and re-dispersibility of the grains when the speed of development is increased or with respect to press life (printing durability) in the case of large-size (e.g., size A3 or larger) master plates.

The present invention resolves the above-noted problems associated with conventional liquid developing agents.

It is an object of the invention to provide a liquid developing agent with which there is excellent dispersion stability, re-dispersibility and fixing characteristics even in an electrostatic photographic plate making system in which the steps of development step to fixing step are made fast and large-size master plates are used.

It is another object of the invention to provide a liquid developing agent which permits production of original offset printing plates with excellent printing ink receptivity and durability in printing.

It is a further object of the invention to provide a liquid developing agent which in addition to the above-noted applications is suitable for various types of electrostatic photography and various types of transfer applications.

Yet another object of the invention is to provide a liquid developing agent which is employable in all systems which can use liquid developing agent such as systems for ink jet recording, cathode ray tube recording and pressure change, static electricity change or similar change process recording. The use is described, for example, in *Kiroku-Zairyo to Kankosei-jushi* (*Recording Materials and Photosensitive Resin*), edit. by Shinohara et al. published by Gakkai Shuppan Center (October 1979).

SUMMARY OF THE INVENTION

The objects of the invention are achieved by a liquid developing agent for electrostatic photography comprising resin grains which are dispersed in a nonaqueous solvent with an electrical resistance of $10^9$ Ω cm or more and a permittivity of 3.5 or less, wherein the dispersed resin grains are:

polymer resin grains produced by a polymerization reaction of a solution containing at least one monofunctional monomer (A) which is soluble in the nonaqueous solvents, but is made insoluble by polymerization, and at least one resin (B) for dispersion stabilization that is soluble in the nonaqueous solvent and is a polymer which has repeating units represented by the general formula (I) below, a portion of which is crosslinked and in which an acidic group selected from among $—PO_3H_2$, $—SO_3H$, —COOH, —OH, —SH and

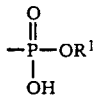

groups (where $R^1$ represents a hydrocarbon group) is bonded to one end of at least one polymer main chain,

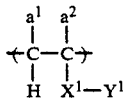

(I)

wherein $X^1$ represents —COO—, —OCO—, $—CH_2OCO—$ $—CH_2COO—$, —O— or $—SO_2—$, $Y^1$ represents an aliphatic group having from 6 to 32 carbon atoms, and $a^1$ and $a^2$ may be the same or different and each represents a hydrogen atom, a halogen atom, a cyano group, a hydrocarbon group having from 1 to 8 carbon atoms, $—COO—Z^1$ or $—COO—Z^1$ linked via hydrocarbon group having from 1 to 8 carbon atoms (where $Z^1$ represents a hydrocarbon group having from 1 to 18 carbon atoms).

DETAILED DESCRIPTION OF THE INVENTION

There now follows a detailed description of the invention. The aliphatic groups and hydrocarbon groups in the repeating units represented by formula (I) may be substituted.

In general formula (I), $X^1$ is preferably —COO—, —OCO—, $—CH_2OCO—$, $—CH_2COO—$ or —O— and even more preferably —COO—, $—CH_2COO—$ or —O—.

$Y^1$ is preferably an alkyl, alkenyl or aralkyl group having from 8 to 22 carbon atoms, which may be substituted. The substituent groups include, for example, halogen atoms (e.g., fluorine, chlorine, bromine), $—O—Z^2$, $—COO—Z^2$ and $—OCO—Z^2$(where $Z^2$ represents an alkyl group having from 6 to 22 carbon atoms, and examples thereof include hexyl, octyl, decyl, dodecyl, hexadecyl, octadecyl, etc.). $Y^1$ is more preferably an alkyl group having from 8 to 22 carbon atoms and an alkenyl group having from 8 to 22 carbon atoms. Examples thereof include octyl, decyl, dodecyl, tridecyl, tetradecyl, hexadecyl, octadecyl, docosanyl, decenyl, dodecenyl, tetradecenyl, hexadecenyl and octadecenyl.

$a^1$ and $a^1$ may be the same or different and are preferably hydrogen atoms, halogen atoms (e.g., fluorine, chlorine, bromine), cyano groups, alkyl groups having from 1 to 3 carbon atoms, $—COO—Z^3$ or $—CH_2COO—Z^3$ (where $Z^3$ represents an aliphatic group having from 1 to 22 carbon atoms, examples thereof include methyl, ethyl, propyl, butyl, hexyl, octyl, decyl, dodecyl, tridecyl, tetradecyl, hexadecyl, octadecyl, docosanyl, pentenyl, hexenyl, heptenyl, octenyl, decenyl, dodecenyl, tetradecenyl, hexadecenyl and octadecenyl, and these aliphatic groups may possess substituents such as indicated by $Y^1$ above). Still more preferably $a^1$ and $a^2$ each represents hydrogen atoms, alkyl groups having from 1 to 3 carbon atoms (e.g., methyl, ethyl, propyl), $—COO—Z^4$ or $—CH_2COO—Z^4$ (where $Z^4$ represents an alkyl group having from 1 to 12 carbon atoms or alkenyl group, e.g., a methyl ethyl, propyl, butyl, hexyl, octyl, decyl, dodecyl, pentenyl, hexenyl, heptenyl, octenyl or decenyl group, and these alkyl and alkenyl groups may possess substituent such as indicated by $Y^1$ above.)

A straight chain or branched aliphatic hydrocarbon, alicyclic hydrocarbon or aromatic hydrocarbon or halogen substituted compounds thereof may be suitably employed as the carrier solution with an electrical resistance of $10^9$ Ω cm or more and a permittivity of 3.5 or less that is used in the invention. For example, octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: tradename of the Exxon Corporation), Shellsol 70, Shellsol 71 (Shellsol: tradename of the Shell Oil Company), Amsco OMS, Amsco 460 Solvent (Amsco: tradename of the Splitz Company) may be used alone or mixed.

The nonaqueous dispersion resin grains which are the most important constituent element in the invention (and which will sometimes be called 'latex grains' below) are manufactured by granulation polymerization through polymerization of a monofunctional monomer (A) in a nonaqueous solvent in the presence of a resin (B) for dispersion stabilization in which a portion of the polymer chains of resin B are crosslinked and have an acidic group selected from among $—PO_3H_2$, $—SO_3H$, —COOH, —OH, —SH and

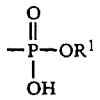

groups (where $R^1$ represents a hydrocarbon group) bonded to one end of at least one polymer main chain.

Basically, solvents for serving as the nonaqueous solvent here are employable if they are miscible with a carrier solution for a liquid developing agent for electrostatic photography as noted above.

That is, it is satisfactory as long as the solvent used in manufacture of the dispersion resin is miscible with the above-noted carrier solution and preferred examples include straight chain or branched aliphatic hydrocarbons, alicyclic hydrocarbons or aromatic hydrocarbons or halogen substituted compounds of these substances. For example, the solvents hexane, octane, isooctane, decane, isodecane, decalin, nonane, dodecane, isododecane, Isopar E, Isopar G, Isopar H, Isopar L, Shellsol 70, Shellsol 71, Amsco OMS and Amsco 460 solvent may be used alone or mixed.

Examples of solvents that can be used mixed with these organic solvents include alcohols (e.g., methyl, ethyl, propyl, butyl or fluorinated alcohols), ketones (e.g., acetone, methylethylketone, cyclohexanone), carboxylic acid esters (e.g., methyl acetate, ethyl acetate, propyl acetate, butyl acetate, methyl propionate, ethyl propionate), ethers (e.g., diethyl ether, dipropyl ether, tetrahydrofuran, dioxan) and hydrocarbon halides (e.g., methylene dichloride, chloroform, carbon tetrachloride, dichloroethane, methyl chloroform).

Preferably, these nonaqueous solvents that are used mixed are distilled off by heating or distillation under reduced pressure, after granulation polymerization and, but even if they are carried into the liquid developing agent there are no problems as far as the latex grain dispersion is concerned as long as the resistance of the development solution is $10^9$ Ω cm or more.

Normally, it is better if the solvent used in the resin dispersion stage is one similar to that used for the carrier solution, examples of such a solvent being straight chain or branched aliphatic hydrocarbons, alicyclic hydrocarbons, aromatic hydrocarbons or hydrocarbon halides as noted above.

The monofunctional monomer (A) in the invention may be any monofunctional monomer as long as it is soluble in a nonaqueous solvent, but is rendered insoluble by polymerization. For example, one may cite the monomers which are represented by formula (II):

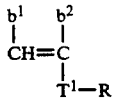

(II)

where $T^1$ represents —COO—, —OCO—, —$CH_2$OCO—, —$CH_2$COO—, —O—,

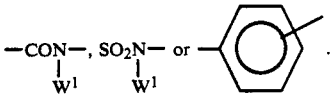

$W^1$ here represents a hydrogen atom or an optionally substituted aliphatic group having from 1 to 18 carbon atoms (e.g., methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl, fluorobenzyl, 2-methoxyethyl, 3-methoxypropyl).

R represents a hydrogen atom or an optionally substituted aliphatic group having from 1 to 6 carbon atoms (e.g., methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxyethyl, 2-hydroxy-3-chloropropyl, 2-cyanoethyl, 3-cyanopropyl, 2-nitroethyl, 2-methoxyethyl, 2-methanesulfonylethyl,2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cyclopentyl, chlorocyclohexyl, dichlorohexyl).

$b^1$ and $b^2$ may be the same or different and may represent the same substituents as $a^1$ and $a^2$ in the above-noted general formula (I).

Specific examples of the monofunctional monomer (A) include vinyl esters or allyl esters of aliphatic carboxylic acids having from 1 to 6 carbon atoms (acetic acid, propionic acid, butyric acid, monochloroacetic acid, trifluoropropionic acid, etc.), optionally substituted alkyl esters or amides of acrylic, methacrylic, crotonic, itaconic, maleic or similar unsaturated carboxylic acids (there being by way of alkyl groups such as those having from 1 to 4 carbon atoms, e.g., methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-carboxyethyl, 2-phosphoethyl, 4-carboxybutyl, 3-sulfopropyl, 4-sulfobutyl, 3-chloropropyl, 2-hydroxy-3-chloropropyl, 2-furfurylethyl, 2-pyridinylethyl, 2-thienylethyl, trimethoxysilylpropyl and 2-carboxyamidoethyl), styrene derivatives (e.g., styrene, vinyltoluene, alpha-methylstyrene, vinylnaphthalene, chlorostyrene, dichlorostyrene, bromostyrene, vinylbenzenecarboxylic acid, vinylbenzenesulfonic acid, chloromethylstyrene, hydroxymethylstyrene, methoxymethylstyrene, N,N-dimethylaminomethylstyrene, vinylbenzenecarboxyamide, vinylbenenesulfonamide), acrylic, methacrylic, crotonic, maleic, itaconic or similar unsaturated carboxylic acids or cyclic anhydrides of maleic or itaconic acid, acrylonitrile, methacrylonitrile and polymerizable heterocyclic compounds containing double bonds (specific examples of which include the compounds described on p. 175–184 of 'High Polymer Handbook-Basics', edited by the Kobunshi Gakkai (High Polymer Institute), published 1986 by Baifukan, e.g., N-vinylpyridine, N-vinylimidazole, N-vinylpyrrolidone, vinylthiophene, vinyltetrahydrofuran, vinyloxazoline, vinylthiazole, N-vinylmorpholine).

Joint use of two or more monomers (A) may be made.

The dispersion stabilization resin (B) of the invention which may be used to make a stable resin dispersion of the polymer which is produced by polymerizing a monomer in a nonaqueous solvent and is insoluble in that solvent is a resin which does not contain graft groups that polymerize with monomer (A) and is a polymer which possesses at least one repeating unit represented by formula (I), a portion of which is crosslinked and which has bonded to one end of at least one main chain at least one acidic group selected from among carboxyl, sulfo, phosphono, hydroxyl, mercapto and

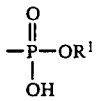

groups [($R^1$ here preferably being a hydrocarbon group having from 1 to 18 carbon atoms and more preferably being an optionally substituted aliphatic group having from 1 to 8 carbon atoms (e.g., methyl, ethyl, propyl, butyl, hexyl, octyl, 2-chloroethyl, 2-methoxyethyl, butenyl, pentenyl, hexenyl, benzyl, phenethyl, bromobenzyl, methoxybenzyl, chlorobenzyl, methylbenzyl, cyclopentyl, cyclohexyl) or an optionally substituted aryl group (e.g., phenyl, tolyl, xylyl, chlorophenyl, bromophenyl, methoxyphenyl, ethylphenyl, methoxycarbonylphenyl)]. The acidic group here has a chemical structure whereby it is bonded directly or via any linkage group to one end of the polymer main chain.

Linkage groups comprises groups constituted by any combination of the atomic groups of carbon—carbon bonds (single or double bond), carbon—heteroatom bonds (examples of heteroatoms including oxygen, sulfur, nitrogen and silicon atoms) and heteroatom—heteroatom bonds. Examples one may cite include linkage groups constituted by linkage groups, used alone or in any combination, that are selected from among

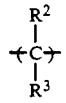

(where $R^2$ and $R^3$ each represents a hydrogen atom, halogen atom, (e.g., fluorine, chlorine, bromine), cyano groups, hydroxyl groups, alkyl groups (e.g., methyl, ethyl, propyl),

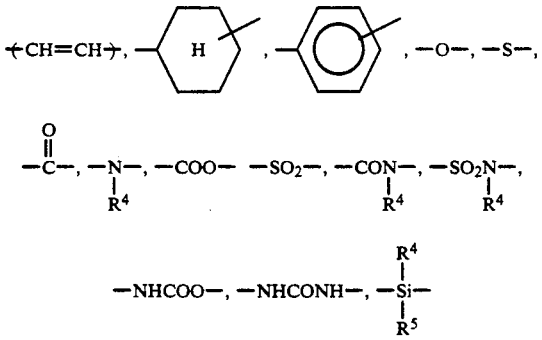

(where $R^4$ and $R^5$ each individually represents a hydrogen atom, or the hydrocarbon groups as defined for $R^1$ in general formula (I)).

The polymer components of the dispersion stabilization resin (B) of the invention include homopolymer or copolymer components selected from repeating units represented by general formula (I) and copolymer components produced by polymerization with other monomers that are copolymerizable with monomers corresponding to repeating units represented by formula (I) and are polymers of which portion is crosslinked.

One may use commonly known methods for introducing a crosslinked structure into the polymer. In more detail, there are methods in which polymerization is effected with polyfunctional monomers introduced into the monomer polymerization reaction and methods in which crosslinking is effected by a macromolecular reaction with a polymer including functional groups which cause a crosslinking reaction to proceed.

Since simplicity of the manufacturing procedure is required, that is, it is required that the reaction involved has a constant rate reaction, the reaction takes a short time and there is no admixture of impurities due to use of reaction accelerators, Etc., the preferred dispersion stabilization resin (B) of the invention is obtained by crosslinking reaction using the functional groups, such as $—CONCH_2OR^6$ (where $R^6$ indicates a hydrogen atom or alkyl group), which give rise to self-crosslinking reactions, or using polymerization reaction.

A preferred method for the polymerization reaction is one in which crosslinking between polymer chains is effected through polymerization of monomers possessing two or more polymerizable functional groups and monomers corresponding to the repeating units represented by formula (I).

Specific examples of polymerizable functional groups include

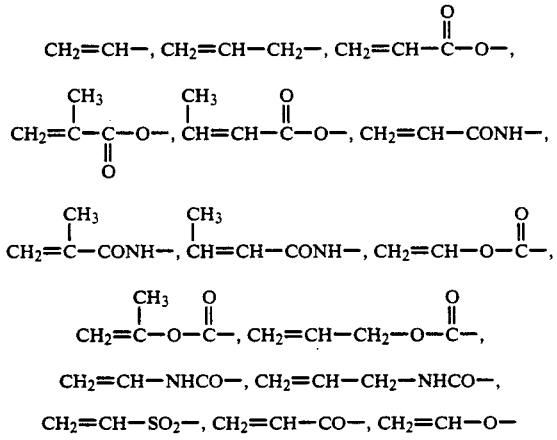

and $CH_2=CH—S—$ and it is satisfactory if as the monomers possessing two or more of the above polymerizable functional groups, monomers having two or more of the same or different polymerizable functional groups.

Specific examples that one may cite of monomers possessing two or more of the same polymerizable functional groups include, styrene derivatives such as divinylbenzene and trivinylbenzene, etc.; methacrylic, acrylic or crotonic acid esters or vinyl ethers or allyl ethers of polyhydric alcohols (e.g., ethylene glycol, diethylene glycol, triethylene glycol, polyethylene glycol #200, #400, #600, 1,3-butylene glycol, neopentyl glycol, dipropylene glycol, polypropylene glycol, trimethylol propane, trimethylol ethane, pentaerythritol), and polyhydroxyphenols (e.g., hydroquinone, resorcinol, catechol or derivative thereof); dibasic acid (e.g., malonic, succinic, glutaric, adipic, pimelic, maleic, phthalic or itaconic acid) vinyl esters, allyl esters, vinylamides or allylamides; condensates of polyamines (e.g., ethylenediamine, 1,3-propylenediamine, 1,4-butylenediamine) and carboxylic acids containing vinyl groups (e.g., methacrylic, acrylic, crotonic, allylacetic acid).

Examples one may cite of monomers with different polymerizable functional groups include vinyl-group-containing ester derivatives or amide derivatives which are derived from vinyl-group-containing carboxylic acid, such as methacrylic acid, acrylic acid, methacryloylacetic acid, acryloylacetic acid, methacryloylpropionic acid, acryloylpropionic acid, itaconoylacetic acid, itaconoylpropionic acid and which are derived from a reaction of carboxylic acid anhydrides and alcohols or amines (e.g., allyloxycarbonylpropionic acid, allyloxycarbonylacetic acid, 2-allyloxycarbonylbenzoic acid, allylaminocarbonylpropionic acid), and vinyl-group-containing ester derivatives or amide derivatives which are derived from condensates of aminoalcohols (e.g., aminoethanol, 1-aminopropanol, 1-aminobutanol, 1-aminohexanol, 2-aminobutanol) and vinyl-group-containing carboxylic acids. Specific examples of vinyl-group-containing ester derivatives or amide derivatives include vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, methacrylic acid vinyloxycarbonylmethyl ester, acrylic acid vinyloxycarbonylmethyloxycarbonylethylene ester, N-allylacrylamide, N-allylmethacrylamide, N-allylitaconic acid amide, methacryloylpropionic acid allyl amide.

The resin of the invention that is soluble in the nonaqueous solvent may be formed by effecting polymerization with the monomers possessing two or more polymerizable functional groups that are used in the invention representing preferably 0.05 to 15 wt % and more preferably 0.1 to 10 wt % of the total monomers.

The dispersion stabilization resin (B) of the invention which is formed by bonding a specific acidic group to one end of at least one main polymer chain can easily be manufactured by synthesis processes such as conventionally known processes in which various reagents are reacted with the ends of living polymers produced by anionic or cationic polymerization (an ionic polymerization method), processes in which radical polymerization is effected using chain transfer agents and/or polymerization initiators in whose molecules specific acidic groups have been included (a radical polymerization method) or processes in which polymers that are produced by ionic or radical polymerization processes such as above and contain reactive groups at their ends are converted to the polymers having specific acidic groups of the invention by a macromolecular reaction.

Specific examples of methods by which the resin can be manufactured include the methods described in the surveys by P. Dreyfuss and R. P. Quirk, Encycl. Polym, Sci. Eng., 7, 551 (1987), Y. Chujo and T. Yamashita in "Senryo to Yakuhin" ('Dyes and Chemicals'), 30, 232 (1985) and A. Ueda and S. Nagai in 'Kagaku to Kogyo' ('Science and Industry'), 60, 57 (1986) and the documents cited in these surveys.

Preferably the weight-average molecular weight of the dispersion stabilization resin (B) of the invention is $1\times10^4$ to $2\times10^5$ and still more preferably it is $2.5\times10^4$ to $1\times10^5$. If the weight-average molecular weight is less than $1\times10^4$ the average grain diameter of the resin grains produced by polymerization and granulation becomes large (for example, greater than 0.5 μm) and there is a broad grain diameter distribution. Also, if it exceeds $2\times10^5$ the average grain diameter of the resin grains produced by polymerization and granulation is large and it is difficult to bring the average grain size into the preferred range of 0.15–0.4 μm.

Specific processes for manufacturing the dispersion stabilization resin that is used in the invention include (1) processes in which mixtures of monomers corresponding to the repeating units represented by formula (I), polyfunctional monomers such as noted earlier and chain transfer agents containing the above-noted acidic groups are polymerized using polymerization initiators (e.g., azobis compounds or peroxides), (2) processes in which these chain transfer agents are not used, but polymerization is effected using polymerization initiators which contain the relevant acidic groups, (3) processes using compounds in which the acidic groups are included both in the chain transfer agents and in the polymerization initiators, and (4) processes in which a polymerization reaction effected using compounds containing amino groups, halogen atoms, epoxy groups or acid halide groups, etc. as a substituent of the chain transfer agent or polymerization initiator substitution groups is followed by a macromolecular reaction to introduce these acidic groups into the polymer.

Examples of chain transfer agents include mercapto compounds containing the relevant acidic groups or substituent groups from which the acidic groups can be derived (e.g., thioglycolic acid, thiomalonic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]-propionic acid, N-(3-mercaptopropionyl)-alanine, 2-mercapto-ethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, 2-mercapto-3-pyridinol) and iodinated alkyl compounds containing the above-noted acidic groups or substituent groups (e.g., iodoacetic acid, iodopropionic acid, 2-iodoethanol, 2-iodoethanesulfonic acid, 3-iodopropanesulfonic acid). Mercapto compounds can be cited as preferred compounds.

The amounts of such chain transfer agents and polymerization initiators relative to 100 parts by weight of the total monomers are from 0.5 to 15 parts by weight and preferably from 1 to 10 parts by weight in each case.

It is surmised that affinity of the dispersion stabilization resin (B) obtained in the manner described above to the nonaqueous solvent is markedly improved, because it interacts with the insoluble resin grains, due to the acidic group bonded to only one end of the main polymer chain of the dispersion stabilization resin (B), and because the component to be soluble in the nonaqueous solvent is crosslinked, and it is thought that for these reasons aggregation and precipitation of the insoluble grains are inhibited and their re-dispersibility is greatly improved.

Generally, to manufacture the latex grains that are used in the invention, it is simply necessary to polymerize with heat a dispersion stabilization resin (B) and monomer (A) such as described above in the nonaqueous solvent in the presence of a polymerization initiator such as benzoyl peroxide, azobisisobutyronitrile or butyl lithium, etc. More specifically, they may be manufactured by any process such as a process in which a polymerization initiator is added to a mixed solution of the dispersion stabilization resin (B) and monomer (A), a process in which the monomer (A) is added dropwise together with the polymerization initiator to a solution in which the dispersion stabilization resin (B) is dissolved, a process in which a solution containing all the dispersion stabilization resin (B) and a portion of the monomer (A) is added in any required manner to the polymerization initiator together with the remaining monomer (A), or a process in which a mixed solution of the dispersion stabilization resin (B) and monomer (A) is added together with the polymerization initiator in any required manner to the nonaqueous solvent.

The total amount of the monomer (A) is around 5 to 80 parts by weight and preferably from 10 to 50 parts by weight relative to 100 parts by weight of the nonaqueous solvent.

The amount of the soluble resin constituted by the dispersion stabilization resin (B) is from 1 to 100 parts by weight and preferably from 5 to 50 parts by weight relative to 100 parts by weight of the total monomers.

The amount of acid groups bonded to resin (B) is preferably from 0.1 to 15 parts by weight, and more preferably from 0.5 to 10 parts by weight relative to 100 parts by weight of polymer (B).

The amount of the polymerization initiator is suitably from 0.1 to 5% (by weight) of the total amount of monomers.

The polymerization temperature is around 50° to 180° C. and preferably is from 60° to 120° C. The reaction time is preferably from 1 to 15 hours.

In cases where joint use of polar solvents such as alcohols, ketones, ethers or esters, etc. is made in the nonaqueous solvent employed in the reaction or where unreacted portions of the polymerized and granulated monomer (A) remain, it is preferable to remove them by distilling them off by heating to above the boiling points of the said solvent or monomer (A) or by distilling them off under reduced pressure.

The nonaqueous latex grains prepared in the above described manner are fine and have a uniform grain size distribution and they also display very stable dispersibility. In particular, their dispersibility is good even in long-term, repeated use in a development apparatus and they are easily redispersed and no fouling at all through adhesion to various parts of the apparatus is observed even when the development speed is increased.

Further, when fixing was effected by heating, etc., excellent fixing characteristics were displayed and strong films were formed.

In addition, the dispersion stability, re-dispersibility and fixing characteristics of the liquid developing agent of the invention are excellent even when the development—fixing stages are made fast and large-size master plates are used.

Coloring agents may be used in the liquid developing agent of the invention if required.

There are no particular restrictions with regard to the coloring agents, but various types of conventionally known pigments and dyes may be used.

One example of a method of coloration for coloring the actual dispersion resin itself is to physically disperse a pigment or dye in the dispersion resin. Very many pigments and dyes that can be used for this are known, examples include magnetic iron oxide powders, powdered lead iodide, carbon black, nigrosine, alkali blue, hansa yellow, quinacridone red and phthalocyanine blue.

Another coloration method is to dye the dispersion resin with a suitable dye as disclosed in, e.g., JP-A-57-48738. By way of other methods there is the method in which the dispersion resin and a dye are chemically bonded as disclosed in JP-A-53-54029 and the method in which, as disclosed in JP-B-44-22955, in manufacture by polymerization and granulation, a copolymer containing coloring matter is produced by making use of a monomer into which coloring matter has been introduced beforehand.

The liquid developing agent of the invention may be given addition of a variety of additives if desired for the purpose of reinforcing its charge characteristics or improving the image characteristics, etc. For example, one may use the additives specifically described by Y. Harasaki in 'Denshi Shashin' ('Electronic Photography'), Vol. 16, No. 2, page 44.

One may cite, for example, di-2-ethylhexylsulfosuccinic acid metal salts, naphthenic acid metal salts, higher fatty acid metal salts, lecithin, poly(vinylpyrrolidone) and copolymers containing hemimaleinamide components.

The description continues with reference to the amounts of the various principal components of the liquid developing agent of the invention.

The amount of the toner grains whose main component is resin (together with a coloring agent which is used if required) is preferably 0.5 to 50 parts by weight per 1000 parts by weight of carrier solution. If it is less than 0.5 parts by weight, there is insufficient image density, while if it exceeds 50 parts by weight, fogging is liable to occur in non-image portions. One may also make use as required of the above-noted resin for dispersion stabilization that is soluble in the carrier solution and this may be added to an amount that is of the order of 0.5 to 100 parts by weight per 1000 parts by weight of the carrier solution. The amount of a charge regulator such as mentioned above is preferably 0.001 to 1.0 parts by weight per 1000 parts by weight of the carrier solution. Also, various additives may be added if required. The upper limit of the total amount of these additives is restricted by the development agent's electrical resistance. Thus, it is necessary to control the amounts of the various additives to within this limit, since if the electrical resistance of the liquid developing agent when the toner grains have been removed is lower than $10^9$ Ω cm it is difficult to produce good quality continuous tone images.

There now follows a description of examples of manufacture of the dispersion stabilization resin of the invention, examples of manufacture of latex grains and examples of practice of the invention, although the invention is not limited to these examples.

Dispersion Stabilization Resin Manufacturing Example 1: Manufacture of dispersion stabilization resin P-1

A mixed solution of 97 g of octadecyl methacrylate, 3 g of thioglycolic acid, 5.0 g of divinylbenzene and 200 g of toluene was heated to 85° C. in a nitrogen gas stream while being stirred. 0.8 g of 1.1'-azobis(cyclohexane-1-carbonitrile) (abbreviation A.C.H.N.) was added and reacted for 4 hours, then 0.4 g of A.C.H.N. was added and reacted for 2 hours. After that, 0.2 g of A.C.H.N was added and reacted for 2 hours. After cooling, the mixed solution was reprecipitated in 1.5 liters of methanol, a white powder was collected by filtration and then dried, giving 88 g of powder. The weight-average molecular weight of the resulting polymer was 30,000.

Dispersion Stabilization Resin Manufacturing Examples 2–9: Manufacture of dispersion stabilization resins P-2 to P-9

The various dispersion stabilization resins were manufactured in exactly the same way as Manufacturing Example 1 except that the monomers noted in Table 1 below were employed instead of the octadecylmethacrylate used in Manufacturing Example 1.

Dispersion Stabilization Resin Manufacturing Examples 10–22: Manufacture of dispersion stabilization resins TABLE 1-continued

| Manufacturing Example | Dispersion stabilization resin | Monomer | | Weight-average molecular weight |
|---|---|---|---|---|
| | | 2-(Trimethoxysilyloxy) ethyl methacrylate | 4 g | |
| 8 | P-8 | Hexadecyl methacrylate | 97 g | 31,000 |
| 9 | P-9 | Tetradecyl methacrylate | 97 g | 32,000 |

TABLE 2

| Manufacturing Example | Dispersion stabilization resin | Monomer or oligomer for crosslinking | Amount used | Weight-average molecular weight |
|---|---|---|---|---|
| 10 | P-10 | Ethylene glycol dimethacrylate | 4 g | 35,000 |
| 11 | P-11 | Diethylene glycol dimethacrylate | 4.5 g | 29,000 |
| 12 | P-12 | Vinyl methacrylate | 6 g | 40,000 |
| 13 | P-13 | Isopropenyl methacrylate | 6 g | 33,000 |
| 14 | P-14 | Divinyl adipate | 8 g | 32,000 |
| 15 | P-15 | Diallyl glutaconate | 10 g | 30,000 |
| 16 | P-16 | ISP-22GA (manufactured by Okamura Seiyu KK) | 10 g | 45,000 |
| 17 | P-17 | Triethylene glycol diacrylate | 2 g | 50,000 |
| 18 | P-18 | Trivinylbenzene | 2 g | 55,000 |
| 19 | P-19 | Polyethylene glycol diacrylate #400 | 5 g | 38,000 |
| 20 | P-20 | Polyethylene glycol dimethacrylate | 6 g | 40,000 |
| 21 | P-21 | Trimethylolpropane triacrylate | 1.8 g | 56,000 |
| 22 | P-22 | Polyethylene glycol diacrylate #600 | 6 g | 35,000 |

P-10 to P-22

The various dispersion stabilization resins were prepared following the same procedure as in Manufacturing Example 1 except that, instead of the 5 g of divinylbenzene constituting the polyfunctional monomer in Manufacturing Example 1 use was made of the polyfunctional monomers or oligomers noted in Table 2 below.

TABLE 1

| Manufacturing Example | Dispersion stabilization resin | Monomer | | Weight-average molecular weight |
|---|---|---|---|---|
| 2 | P-2 | Dodecyl methacrylate | 97 g | 32,000 |
| 3 | P-3 | Tridecyl methacrylate | 97 g | 31,000 |
| 4 | P-4 | Octyl methacrylate | 17 g | 29,000 |
| | | Dodecyl methacrylate | 80 g | |
| 5 | P-5 | Octadecyl methacrylate | 70 g | 33,000 |
| | | Butyl methacrylate | 27 g | |
| 6 | P-6 | Dedecyl methacrylate | 92 g | 34,000 |
| | | N,N-Dimethylamino-ethyl methacrylate | 5 g | |
| 7 | P-7 | Octadecyl methacrylate | 93 g | 29,000 |

Dispersion Stabilization Resin Manufacturing Example 23: Manufacture of dispersion stabilization resin P-23

A mixed solution of 97 g of octadecyl methacrylate, 3 g of thiomalonic acid, 4.5 g of divinylbenzene, 150 g of toluene and 50 g of ethanol was heated to 60° C. in a nitrogen gas stream. 0.5 g of 2,2'-azobis(isobutyronitrile) (abbreviation A.I.B.N.) was added and reacted for 5 hours, then 0.3 g of A.I.B.N. was added and reacted for 3 hours and then 0.2 g of A.I.B.N. was added and reacted for 3 hours. After cooling, the material was reprecipitated in 2 liters of methanol and a white powder was collected by filtration and then dried. The yield was 85 g and the polymer's weight-average molecular weight was 35,000.

Dispersion Stabilization Resin Manufacturing Examples 24–29: Manufacture of dispersion stabilization resins P-24 to P-29

The dispersion stabilization resins were manufactured following the same procedure as in Manufacturing Example 23 except the the mercapto compounds indicated in Table 3 below were employed instead of the 3 g of thiomalonic acid that was used in Manufacturing Example 23.

TABLE 3

| Manufacturing Example | Dispersion stabilization resin | Mercapto compound | Weight-average molecular weight |
|---|---|---|---|
| 24 | P-24 | $HSCH_2CH_2COOH$ | 36,000 |
| 25 | P-25 | 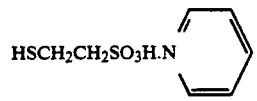 | 29,000 |

TABLE 3-continued

| Manufacturing Example | Dispersion stabilization resin | Mercapto compound | Weight-average molecular weight |
|---|---|---|---|
| 26 | P-26 | 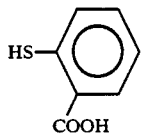 | 38,000 |
| 27 | P-27 | $HSCH_2CH_2-O-\overset{\overset{O}{\|}}{\underset{\underset{OH}{\|}}{P}}-OH$ | 33,000 |
| 28 | P-28 | $HSCH_2CH_2NHCO(CH_2)_2COOH$ | 37,000 |
| 29 | P-29 | $HSCH_2CH_2NHCH_2CH_2COOH$ | 35,000 |

Dispersion Stabilization Resin Manufacturing Example 30: Manufacture of dispersion stabilization resin P-30

A mixture of 94 g of hexadecyl methacrylate, 1.0 g of diethylene glycol dimethacrylate, 150 g of toluene and 50 g of isopropyl alcohol was heated to 90° C. in a nitrogen gas stream. 6 g of 2,2'-azobis(4-cyanovaleric acid) (abbreviation A.C.V.) was added and reacted for 8 hours. After cooling, the reaction solution was reprecipitated in 1.5 liters of methanol and a white powder was collected by filtration and then dried. The yield was 83 g and the polymer's weight-average molecular weight was 65,000.

Dispersion Stabilization Resin Manufacturing Example 31: Manufacture of dispersion stabilization resin P-31

A mixed solution of 92 g of docosanyl methacrylate, 1.5 g of ISP-22GA (manufactured by Okamura Seiyu KK), 150 g of toluene and 50 g of ethanol was heated to 80° C. in a nitrogen gas stream. 8 g of 4,4'-azobis(4-cyanopentanol) was added and reacted for 8 hours. After cooling, the reaction solution was reprecipitated in 1.5 liters of methanol and a white powder was collected by filtration and then dried. The yield was 78 g and the polymer's weight-average molecular weight was 41,000.

Dispersion Stabilization Resin Manufacturing Example 32: Manufacture of dispersion stabilization resin P-32

A mixed solution of 95 g of octadecylmethacrylate, 5 g of 2-mercaptoethylamine, 5 g of divinylbenzene and 200 g of toluene was heated to 85° C. in a nitrogen gas stream. 0.7 g of A.C.H.N. was added and reacted for 8 hours.

Next, 8 g of glutaconic anhydride and 1 ml of concentrated sulfuric acid were added and reacted at a temperature of 100° C. for 6 hours. After cooling, the material was reprecipitated in 1.5 liters of methanol and a white powder was collected by filtration and then dried. The yield was 83 g and the weight-average molecular weight was 31,000.

Dispersion Stabilization Resin Manufacturing Example 33: Manufacture of dispersion stabilization resin P-33

A mixed solution of 95 g of octadecyl methacrylate, 3 g of thioglycolic acid, 6 g of ethylene glycol dimethacrylate, 150 g of toluene and 50 g of ethanol was heated to 80° C. in a nitrogen gas stream. 2 g of A.C.V. was added and reacted for 4 hours and then a further 0.5 g of A.C.V. was added and reacted for 4 hours. After cooling, the material was reprecipitated in 1.5 liters of methanol and a white powder was collected by filtration and then dried. The yield was 80 g and the weight-average molecular weight was 35,000.

Dispersion Stabilization Resin Manufacturing Example 34: Manufacture of dispersion stabilization resin P-34

A mixed solution of 94 g of tridecyl methacrylate, 6 g of 2-mercaptoethanol, 9 g of divinylbenzene, 150 g of toluene and 50 g of ethanol was heated to 80° C. in a nitrogen gas stream. 4 g of A.C.H.N. was added and reacted for 4 hours and then 2 g of A.C.H.N. was added and reacted for further 4 hours.

After cooling, the material was reprecipitated in 1.5 liters of methanol and a viscous substance obtained on removal of the methanol by decantation was dried. The yield was 75 g and the weight-average molecular weight was 29,000.

Dispersion Stabilization Resin Manufacturing Example 35: Manufacture of dispersion stabilization resin P-35

A mixture of 50 g of the above-noted dispersion stabilization resin P-34, 100 g of toluene, 10 g of succinic anhydride and 0.5 of pyridine was reacted for 10 hours at a temperature of 90° C. After cooling, the material was reprecipitated in 0.8 liters of methanol and a viscous substance obtained on removal of the methanol by decantation was dried. The yield was 43 g and the weight-average molecular weight was 30,000.

Dispersion Stabilization Resin Manufacturing Examples 36–39: Manufacture of dispersion stabilization resins P-36 to P-39

The dispersion stabilization resins were manufactured following the same procedure as in Manufacturing Example 35 except that the dicarboxylic anhydrides noted in Table 4 below were employed instead of the succinic anhydride that was used in Manufacturing Example 35 for the above described dispersion stabilization resin P-35.

TABLE 4

| Manufacturing Example | Dispersion stabilization resin | Dicarboxylic acid anhydride | Amount used | Weight-average molecular weight |
|---|---|---|---|---|
| 36 | P-36 | Maleic anhydride | 8.5 g | 30,000 |
| 37 | P-37 | Adipic anhydride | 11 g | 30,000 |
| 38 | P-38 | Phthalic anhydride | 10 g | 30,000 |
| 39 | P-39 | Trimellitic | 12.5 g | 30,000 |

TABLE 4-continued

| Manufacturing Example | Dispersion stabilization resin | Dicarboxylic acid anhydride | Amount used | Weight-average molecular weight |
|---|---|---|---|---|
| | | anhydride | | |

Dispersion Stabilization Resin Manufacturing Example 40: Manufacture of dispersion stabilization resin P-40

A mixture of 86 g of octadecyl methacrylate, 10 g of N-methoxymethylacrylamide, 4 g of thioglycolic acid, 150 g of toluene and 50 g of isopropanol was heated to 80° C. in a nitrogen gas stream.

0.8 g of A.C.H.N. was added and reacted for 8 hours. Then, following the Dean-Stark method, the material was heated to a temperature of 110° C. and stirred for 6 hours. The isopropanol that had served as the solvent and side-product methanol were removed.

After cooling, the material was reprecipitated in 1.5 liters of methanol and a white powder was collected by filtration and then dried. The yield was 82 g and the weight-average molecular weight was 45,000.

Latex Grain Manufacturing Example 1: Manufacture of latex grains D-1

A mixed solution of 20 g of dispersion stabilization resin P-1, 100 g of vinyl acetate and 384 g of Isopar H was heated to 70° C. while being stirred in a nitrogen gas steam. 0.8 g of 2,2'-azobis(isovaleronitrile) (abbreviation A.I.V.N.) was added as a polymerization initiator and the materials were reacted for 3 hours. 20 minutes after addition of the polymerization initiator, white cloudiness appeared and the temperature rose to 88° C. After further addition of 0.5 g of polymerization initiator and reaction for 2 hours, the temperature was raised to 100° C., the material was stirred for 2 hours and unreacted vinyl acetate was removed. After cooling, the material was passed through a 200 mesh nylon cloth, so giving a white dispersion which was latex with a polymerization degree of 90% and an average grain diameter of 0.21 μm.

Latex Grain Manufacturing Examples 2–32: Manufacture of latex grains D-2 to D-32

Latex grains of the invention D-2 to D-32 were manufactured by exactly the same procedure as in Manufacturing Example 1 mentioned above except that the dispersion stabilization resins noted in Table 5 below were employed instead of the dispersion stabilization resin P-1 that was used in Latex Grain Manufacturing Example 1.

TABLE 5

| Manufacturing Example | Latex grains | Dispersion stabilization resin | Latex: Polymerization degree | Latex: Average grain diameter |
|---|---|---|---|---|
| 2 | D-2 | P-2 | 88% | 0.25 μm |
| 3 | D-3 | P-3 | 89% | 0.24 μm |
| 4 | D-4 | P-5 | 87% | 0.28 μm |
| 5 | D-5 | P-8 | 90% | 0.24 μm |
| 6 | D-6 | P-9 | 89% | 0.23 μm |
| 7 | D-7 | P-10 | 88% | 0.25 μm |
| 8 | D-8 | P-11 | 89% | 0.22 μm |
| 9 | D-9 | P-14 | 88% | 0.22 μm |
| 10 | D-10 | P-16 | 86% | 0.21 μm |
| 11 | D-11 | P-18 | 90% | 0.23 μm |
| 12 | D-12 | P-20 | 88% | 0.19 μm |
| 13 | D-13 | P-24 | 89% | 0.20 μm |

TABLE 5-continued

| Manufacturing Example | Latex grains | Dispersion stabilization resin | Latex: Polymerization degree | Latex: Average grain diameter |
|---|---|---|---|---|
| 14 | D-14 | P-25 | 87% | 0.20 μm |
| 15 | D-15 | P-26 | 86% | 0.24 μm |
| 16 | D-16 | P-27 | 87% | 0.23 μm |
| 17 | D-17 | P-29 | 90% | 0.21 μm |
| 18 | D-18 | P-34 | 91% | 0.26 μm |
| 19 | D-19 | P-20 | 85% | 0.22 μm |
| 20 | D-20 | P-23 | 88% | 0.23 μm |
| 21 | D-21 | P-25 | 85% | 0.19 μm |
| 22 | D-22 | P-26 | 86% | 0.23 μm |
| 23 | D-23 | P-27 | 84% | 0.20 μm |
| 24 | D-24 | P-28 | 88% | 0.18 μm |
| 25 | D-25 | P-30 | 83% | 0.24 μm |
| 26 | D-26 | P-31 | 84% | 0.18 μm |
| 27 | D-27 | P-32 | 86% | 0.22 μm |
| 28 | D-28 | P-33 | 88% | 0.24 μm |
| 29 | D-29 | P-34 | 83% | 0.26 μm |
| 30 | D-30 | P-35 | 84% | 0.23 μm |
| 31 | D-31 | P-39 | 86% | 0.25 μm |
| 32 | D-32 | P-40 | 88% | 0.27 μm |

Latex Grain Manufacturing Example 33: Manufacture of latex grain D-33

A mixed solution of 20 g of dispersion stabilization resin P-35, 100 g of vinyl acetate and 380 g of isododecane was heated to 70° C. while being stirred in a nitrogen gas stream. 0.9 g of benzoyl peroxide was added as a polymerization initiator and the materials were reacted for 6 hours. 40 minutes after addition of the polymerization initiator, the uniform solution started to become cloudy white and the temperature rose to 85° C. After cooling, the material was passed through a 200 mesh nylon cloth, so giving a white dispersion which was a latex with a polymerization degree of 88% and an average grain diameter of 0.23 μm.

Latex Grain Manufacturing Example 34: Manufacture of latex grain D-34

A mixed solution of 12 g of dispersion stabilization resin P-25, 8 g of poly(octadecyl methacrylate), 100 g of vinyl acetate and 400 g of Isopar H was heated to 75° C. while being stirred in a nitrogen gas stream. 0.7 g of A.I.B.N. was added and reacted for 4 hours and then a further 0.5 g of A.I.B.N. was added and reacted for 2 hours. After cooling, the material was passed through a 200 mesh nylon cloth, so giving a white dispersion which was a latex with a polymerization degree of 83% and an average grain diameter of 0.24 μm.

Latex Grain Manufacturing Example 35: Manufacture of latex grain D-35

A mixed solution of 18 g of dispersion stabilization resin P-36, 200 g of Isopar G were heated to 70° C. while being stirred in a nitrogen gas stream. A mixed solution of 100 g of vinyl acetate, 180 g of Isopar G and 1.0 g of A.I.V.N. was added dropwise over a period of 2 hours and then stirring was continued for a further 4 hours. After cooling, the material was passed through a 200 mesh nylon cloth, so giving a white dispersion which was a latex with a polymerization degree of 85% and an average grain diameter of 0.22 μm.

Latex Grain Manufacturing Example 36: Manufacture of latex grain D-36

A mixed solution of 20 g of dispersion stabilization resin P-1, 90 g of vinyl acetate, 10 g of N-vinylpyrrolidone and 400 g of isododecane was heated to 65° C. while being stirred in a nitrogen gas stream. 1.5 g of A.I.B.N. was added and reacted for 4 hours. After cooling, the material was passed through a 200 mesh nylon cloth, so giving a white dispersion which was a latex with a polymerization degree of 85% and an average grain diameter of 0.25 μm.

Latex Grain Manufacturing Example 37: Manufacture of latex grain D-37

A mixed solution of 20 g of dispersion stabilization resin P-1, 94 g of vinyl acetate, 6 g of crotonic acid and 400 g of Isopar G was heated to 60° C. while being stirred in a nitrogen gas stream. 1.0 g of A.I.V.N. was added and reacted for 2 hours. Further, 0.5 g of A.I.V.N. was added thereto and reacted for further 2 hours. After cooling, the material was passed through a 200 mesh nylon cloth, so giving a white dispersion which was a latex with a polymerization degree of 86% and an average grain diameter of 0.25 μm.

Latex Grain Manufacturing Example 38: Manufacture of latex grain D-38

A mixed solution of 25 g of dispersion stabilization resin P-2, 100 g of methyl methacrylate and 500 g of Isopar H was heated to 60° C. while being stirred in a nitrogen gas stream. 0.7 g of A.I.V.N. was added and reacted for 4 hours. After cooling, the material was passed through a 200 mesh nylon cloth, so giving a white dispersion which was a latex with a polymerization degree of 88% and an average grain diameter of 0.45 μm.

Latex Grain Manufacturing Example 39: Manufacture of latex grain D-39

A mixed solution of 25 g of dispersion stabilization resin P-1, 100 g of styrene and 380 g of Isopar H was heated to 45° C. while being stirred in a nitrogen gas stream. A hexane solution of n-butyllithium was added in an amount to give an n-butyllithium solids fraction of 1.0 g and reacted for 4 hours. After cooling, the material was passed through a 200 mesh nylon cloth, so giving a white dispersion which was a latex with a polymerization degree of 82% and an average grain diameter of 0.35 μm.

Latex Grain Manufacturing Example 40: (Comparison Example A)

Processing that was the same as in Latex Grain Manufacturing Example 1 except that use was made of 20 g of poly(octadecyl methacrylate) and a mixed solution of 100 g of vinyl acetate and 380 g of Isopar H gave a white dispersion containing latex grains with a polymerization degree of 88% and an average grain diameter of 0.23 μm.

Latex Grain Manufacturing Example 41: (Comparison Example B)

A mixed solution of 98 g of octadecyl methacrylate, 2 g of acrylic acid and 200 g of toluene was heated to 75° C. while being stirred in a nitrogen gas stream. 1.0 g of 2,2'-azobis(isobutyronitrile) was added and reacted for 8 hours.

Next, 6 g of glycidyl methacrylate, 1.0 g of t-butyrohydroquinone and 1.2 g of N,N-dimethyldodecylamine were added and the materials were stirred for 40 hours at a temperature of 100° C. After cooling, the material was reprecipitated in 2 liters of methanol and a white powder was collected by filtration and then dried. The yield was 84 g and the weight-average molecular weight was 35,000.

Processing in which a mixed solution of 10 g of this resin, 100 g of vinyl acetate and 390 g of Isopar H was used, but which otherwise was the same as in Latex Grain Manufacturing Example 1 gave a white dispersion consisting of latex grains with a polymerization degree of 89% and an average grain diameter of 0.13 μm.

Latex Grain Manufacturing Example 42: (Comparison Example C)

Processing that was the same as in Latex Grain Manufacturing Example 1 except that use was made of a mixed solution of 12 of a dispersion stabilization resin with the structure indicated below that was synthesized by the method taught in JP-A-61-43757, 100 g of vinyl acetate and 388 g of Isopar H gave a white dispersion consisting of latex grains with a polymerization degree of 88% and an average grain diameter of 0.18 μm.

Dispersion stabilization resin

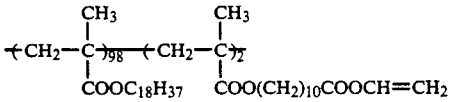

Molecular weight 43,000

EXAMPLE 1

10 g of a dodecyl methacrylate—acrylic acid copolymer (copolymerization ratio: 95/5 weight ratio), 10 g of nigrosine and 30 g of Isopar G were put into a paint shaker (Tokyo Seiki KK) together with glass beads and dispersed for 4 hours, so giving a nigrosine micro-dispersion.

An electrostatic photograph (liquid developing agent was prepared by diluting 2.5 g of this nitrosine dispersion, 30 g of the resin dispersion of Latex Grain Manufacturing Example 1 and 0.07 g of an octadecene/octadecylhemimaleinamide copolymer with 1 liter of Isopar G.

Comparison developing agents A–C

Three liquid developing agents, A, B and C, for comparison were prepared by replacing the resin dispersion used in the manufacture of the above liquid developing agent by the following resin dispersions.

Comparison liquid developing agent A

The resin dispersion of Latex Grain Manufacturing Example 40.

Comparison liquid developing agent B

The resin dispersion of Latex Grain Manufacturing Example 41.

Comparison liquid developing agent C

The resin dispersion of Latex Grain Manufacturing Example 42.

These various liquid developing agents were used as the developing agents for an ELP404V fully automatic developing unit (manufactured by Fuji Photo Film Co., Ltd.), and ELP Master II Type, which is an electrostatic photosensitive material (Manufactured by Fuji Photo Film Co., Ltd.), was exposed and subjected to a development treatment. The platemaking speed was 7n plates/minute. After processing of 2000 plates of ELP Master II Type, an examination was made to check for staining through adhesion of toner to the development apparatus. The blackening ratio of copy images (area of the images) was checked using original documents having 30% of image area. Findings are given in Table 6.

TABLE 6

| No. | Test | Developing agent | Fouling of development unit | Image of 2000th plate |
|---|---|---|---|---|
| 1 | The invention | Example 1 | No stain at all | Clear |
| 2 | Comparison Example A | Developing agent A | Marked toner sediment | Letters missing, scratches in blocked portions, fogging in ground |
| 3 | Comparison Example B | Developing agent B | Small amount of toner sediment | Reduced density of blocked image portions |
| 4 | Comparison Example C | Developing agent C | Small amount of toner sediment | Clear |

As is clear from the results shown in Table 6, when plates were made at the very fast platemaking speed noted above using the various developing agents, it was only with the developing agent of the invention that there was absence of stain of the development apparatus and also that the image of the 2000th plate produced was clear.

Master plates for offset print (ELP masters) that were produced using the various developing agent were employed for printing by normal procedure and a comparison was made of the numbers of prints that could be made before drop-out of letters or scratches in blocked portions, etc. occurred in the images of the printed items. It was found that with master plates produced using the developing agents of the invention, Comparison Example A, Comparison Example B and Comparison Example C no such stains occurred even after more than 10,000 printings.

It is seen from these results that it was only with a developing agent using resin grains of the invention that there was a complete absence of stain of the development apparatus and also that the number of master plate printings was good.

That is, with Comparison Examples A, B and C, there was no problem with the number of printings, but stain of the development apparatus occurred and the developing agents of these examples did not permit continuous use.

Comparison Examples B and C were very much better than Comparison Example A with respect to stain of the development apparatus, but they still failed to offer satisfactory performance in severe development conditions. It is thought that the re-dispersibility of the latex grains in the case of the known dispersion stabilization resin of Comparison Example B is inferior to that achieved with the dispersion stabilization resin of the invention since in this known dispersion stabilization resin, a component containing polymerizable double bond groups that are copolymerized with monomer (A) (corresponding to vinyl acetate in this example) contained in the polymer is randomly copolymerized in the polymer.

The known dispersion stabilization resin of Comparison Example C has a chemical structure in which the total number of atoms of the linkage group which links a portion of the polymer main chain of the said resin and a polymerizable double bond group in the said resin which copolymerizes with monomer (A) is 9 or more, and, as opposed to the $$CH_2{=}\overset{\overset{\displaystyle CH_3}{|}}{C}{-}COO{-}$$

structure polymerizable double bond group of Comparison Example B, the structure polymerizable double bond group of Comparison Example C is $CH_2{=}CH{-}OCO{-}$, which is better suited to reaction with vinyl acetate [monomer (A)]. Thanks to this, the image of the 2000th plate was clear and results were much better than those achieved by Comparison Example B. However, even Comparison Example C failed to give satisfactory performance with regard to fouling of the development apparatus when the development conditions became severe.

EXAMPLE 2

A mixture of 100 g of the white resin dispersion produced in Latex Grain Manufacturing Example 1 and 1.5 g of Simicaron black was heated to 100° C. and stirred while heating for 4 hours. Passage of the material through a 200 mesh nylon cloth and removal of the remaining dye following cooling to room temperature gave a black resin dispersion with an average grain size of 0.21 μm.

A liquid developing agent was prepared by diluting 30 g of this black resin dispersion and 0.05 g of zirconium naphthenate with 1 liter of Shellsol 71.

When development was effected using an apparatus as in Example 1, there was no occurrence at all of stain of the apparatus due to toner adhesion even after development of 2000 images.

Further, there was clear image quality with the offset printing master plate that was produced and the images of printed items were still very clear even after 10,000 printings.

EXAMPLE 3

A mixture of 100 g of the white resin dispersion produced in Latex Grain Manufacturing Example 37 and 3 g of victoria blue B was heated to 70° to 80° C. and stirred for 6 hours. Passage of the material through a 200 mesh nylon cloth and removal of the remaining dye following cooling to room temperature gave a blue resin dispersion with an average grain size of 0.25 μm.

A liquid developing agent was prepared by diluting 32 g of this blue resin dispersion and 0.05 g of zirconium naphthenate with 1 liter of Isopar H.

When development was effected using an apparatus as in Example 1, no stain at all of the apparatus by adhering toner was observed even after development of 2000 sheets. Further, there was clear image quality with the offset printing master plate that was produced and the images of printed items were still very clear even after 10,000 printings.

EXAMPLE 4

A liquid developing agent was prepared by using 1 liter of Isopar G to dilute 32 g of the white resin dispersion produced in Latex Grain Manufacturing Example 11, 2.5 g of the nigrosine dispersion produced in Example 1 and 0.02 g of a diisobutylene/maleic anhydride copolymer hemidocosanylamide compound.

When development was effected using an apparatus as in Example 1, no staining at all of the apparatus by adhering toner was observed even after development of 2000 sheets. Further, there was very clear image quality with the offset printing master plate that was produced and the images of printed items were still very clear even after 10,000 printings.

Further, when exactly the same processing was effected after the developing agent had been left for 3 months, no timewise changes at all were observed.

EXAMPLE 5

An alkali blue microdispersion was produced by putting 10 g of poly(decyl methacrylate), 30 g of Isopar H and 8 g of alkali blue into a paint shaker together with glass beads and effecting dispersion for 2 hours.

A liquid developing agent was prepared by using 1 liter of Isopar G to dilute 30 g of the white resin dispersion produced in Latex Grain Manufacturing Example 1, 4.2 g of the alkali blue dispersion described above, 15 g of the higher alcohol FOC-1400 (manufactured by Kao KK) and 0.06 g of a diisobutylene/maleic anhydride copolymer hemidocosanylamide compound.

When development was effected using an apparatus as in Example 1, no staining at all of the apparatus by adhering toner was observed even after development of 2000 images. Further, there was very clear image quality with the offset printing master plate that was produced and the images of printed items were still very clear even after 10,000 printings.

EXAMPLES 6-29

Liquid developing agents were prepared following the same procedure as in Example 5 except that instead of the white resin dispersion of Latex Grain Manufacturing Example 1 that was employed in Example 5 use was made of the latex grains noted in Table 7 to amounts corresponding to 6.0 g in terms of solid fractions.

TABLE 7

| Example | Latex grains | Staining of development apparatus | Image of 2000th plate |
|---|---|---|---|
| 6 | D-4 | No occurrence at all of fouling | Clear |
| 7 | D-6 | No occurrence at all of fouling | " |
| 8 | D-7 | No occurrence at all of fouling | " |
| 9 | D-8 | No occurrence at all of fouling | " |
| 10 | D-9 | No occurrence at all of fouling | " |
| 11 | D-10 | No occurrence at all of fouling | " |
| 12 | D-11 | No occurrence at all of fouling | " |
| 13 | D-5 | No occurrence at all of fouling | " |

TABLE 7-continued

| Example | Latex grains | Staining of development apparatus | Image of 2000th plate |
|---|---|---|---|
| 14 | D-2 | No occurrence at all of fouling | " |
| 15 | D-3 | No occurrence at all of fouling | " |
| 16 | D-19 | No occurrence at all of fouling | " |
| 17 | D-22 | No occurrence at all of fouling | " |
| 18 | D-24 | No occurrence at all of fouling | " |
| 19 | D-25 | No occurrence at all of fouling | " |
| 20 | D-26 | No occurrence at all of fouling | " |
| 21 | D-27 | No occurrence at all of fouling | " |
| 22 | D-29 | No occurrence at all of fouling | " |
| 23 | D-30 | No occurrence at all of fouling | " |
| 24 | D-31 | No occurrence at all of fouling | " |
| 25 | D-32 | No occurrence at all of fouling | " |
| 26 | D-33 | No occurrence at all of fouling | " |
| 27 | D-34 | No occurrence at all of fouling | " |
| 28 | D-38 | No occurrence at all of fouling | " |
| 29 | D-39 | No occurrence at all of fouling | " |

When development was effected using an apparatus as in Example 1, no staining at all of the apparatus by adhering toner was observed even after development of 2000 sheets. Further, there was very clear image quality with the offset printing master plates that were produced and the images of printed items were still very clear even after 10,000 printings.

The invention gave developing solutions with excellent dispersion stability, re-dispersibility and fixing characteristics. In particular, there was not fouling of the development apparatus even in conditions of very fast platemaking and the images of offset master printing plates that were produced and also the images of printed items after 10,000 printings were of very clear quality.

While the invention has been described in detail and with reference to specific embodiments thereof, it will be apparent to one skilled in the art that various changes and modifications can be made therein without departing from the spirit and scope thereof.

What is claimed is:

1. A liquid developing agent for electrostatic photography comprising resin grains dispersed in a nonaqueous solvent with an electrical resistance of $10^9$ Ω cm or more and a permittivity of 3.5 or less, wherein said dispersed resin grains are polymer resin grains produced by a polymerization reaction of a solution containing:

at least one monofunctional monomer (A) which is soluble in the nonaqueous solvents, but is made insoluble by polymerization; and at least one resin (B) for dispersion stabilization that is soluble in said nonaqueous solvent and is a polymer which has repeating units represented by formula (I) below, a portion of which is crosslinked and in which an acidic group selected from among $—PO_3H_2$, $—SO_3H$, —COOH, —OH, —SH and

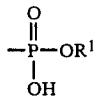

groups, wherein $R^1$ represents a hydrocarbon group, is bonded to only one end of at least one polymer main chain:

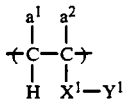

(I)

wherein $X^1$ represents —COO—, —OCO—, —$CH_2$OCO—, —$CH_2$COO—, —O— or —$SO_2$—;

$Y^1$ represents an aliphatic group having from 6 to 32 carbon atoms; and $a^1$ and $a^2$ may be the same or different and each represents a hydrogen atom, a halogen atom, a cyano group, a hydrocarbon group having from 1 to 8 carbon atoms, —COO—$Z^1$ or —COO—$Z^1$ linked via a hydrocarbon group having from 1 to 8 carbon atoms, where $Z^1$ represents a hydrocarbon group having from 1 to 18 carbon atoms, and wherein said resin (B) is a resin which does not contain graft groups that polymerize with monomer (A).

2. A liquid developing agent as in claim 1, wherein $Y^1$ is an alkyl, alkenyl or aralkyl group having from 8 to 22 carbon atoms which may be substituted with a substitutent selected from halogen atoms, —O—$Z^2$, —COO—$Z^2$ and —OCO—$Z^2$, where $Z^2$ represents an alkyl group having from 6 to 22 carbon atoms.

3. A liquid developing agent as in claim 1, wherein $a^1$ and $a^2$ may be the same or different and are hydrogen atoms, halogen atoms, cyano groups, alkyl groups having from 1 to 3 carbon atoms, —COO—$Z^3$ or —$CH_2$COO—$Z^3$, where $Z^3$ represents an alipahtic group having from 1 to 22 carbon atoms.

4. A liquid developing agent as in claim 1, wherein monofunctional monomer (A) is represented by formula (II):

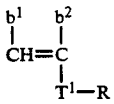

(II)

wherein $T^1$ represents —COO—, —OCO—, —$CH_2$OCO—, —$CH_2$COO—, —O—,

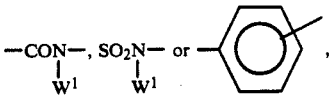

where $W^1$ represents a hydrogen atom or an optionally substituted aliphatic group having from 1 to 18 carbon atoms, R represents a hydrogen atom or an optionally substituted aliphatic group having from 1 to 6 carbon atoms, and $b^1$ and $b^2$ may be the same or different and represent the same as $a^1$ and $a^2$ in formula (I).

5. A liquid developing agent as in claim 1, wherein monofunctional monomer (A) is selected from vinyl esters or allyl esters of aliphatic carboxylic acids having from 1 to 6 carbon atoms; alkyl esters, alkyl moiety having from 1 to 4 carbon atoms, or amides of acrylic, methacrylic, crotonic, itaconic, maleic or similar unsaturated carboxylic acids which may be substituted; styrene derivatives; and acrylic, methacrylic, crotonic, maleic, itaconic or similar unsaturated carboxylic acids or cyclic anhydrides of maleic or itaconic acid, acrylonitrile, methacrylonitrile and polymerizable heterocyclic compounds containing polymerizable double bonds.

6. A liquid developing agent as in claim 1, wherein the acidic group has a chemical structure whereby it is bonded directly or via a linkage group to one end of the polymer main chain of resin (B), and wherein said linkage groups are selected from the group consisting of

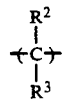

(where $R^2$ and $R^3$ each represents a hydrogen atom, halogen atom, cyano groups, hydroxyl groups, alkyl groups,

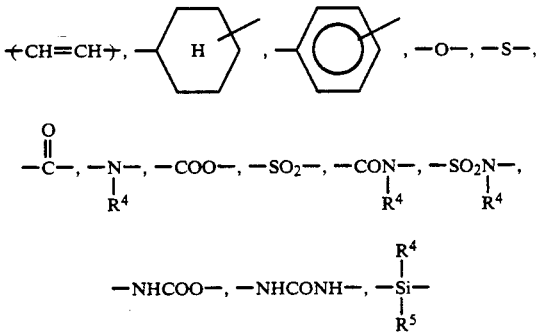

where $R^4$ and $R^5$ each individually represents the hydrocarbon groups as defined for $R^1$ in general formula (I).

7. A liquid developing agent as in claim 1, wherein resin (B) is prepared by a polymerization of a monomer to produce the polymer having repeating units represented by formula (I) and a monomer possessing two or more polymerizable functional groups in an amount of 15 wt % or less of a monomer possessing two or more polymerizable functional groups based on the total monomers.

8. A liquid developing agent as in claim 1, wherein the weight-average molecular weight of the dispersion stabilization resin (B) is from $1\times10^4$ to $2\times10^5$.

9. A liquid developing agent as in claim 1, wherein the total amount of said monomer (A) is from 5 to 80 parts by weight relative to 100 parts by weight of the non-aqueous solvent, and the total amount of said resin (B) is from 1 to 100 parts by weight relative to 100 parts by weight of the total monomers.

* * * * *